US007571776B2

(12) United States Patent
Menzel

(10) Patent No.: US 7,571,776 B2
(45) Date of Patent: Aug. 11, 2009

(54) ANTIVIBRATION UNIT OF A PORTABLE HANDHELD WORK APPARATUS

(75) Inventor: Johannes Menzel, Wernau (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 11/281,413

(22) Filed: Nov. 18, 2005

(65) Prior Publication Data

US 2006/0103497 A1 May 18, 2006

(30) Foreign Application Priority Data

Nov. 18, 2004 (DE) ..... 10 2004 055 758

(51) Int. Cl.
*B25D 17/24* (2006.01)
*B25F 5/00* (2006.01)

(52) U.S. Cl. ..... 173/162.1; 30/381

(58) Field of Classification Search ..... 173/162.1, 173/162.2; 30/381, 340, 388, 312; 16/431, 16/436, 438

See application file for complete search history.

(56) References Cited

U.S. PATENT DOCUMENTS

| | | | | |
|---|---|---|---|---|
| 1,547,774 | A * | 7/1925 | Prellwitz | 173/162.2 |
| 3,342,312 | A * | 9/1967 | Reiter | 198/499 |
| 3,598,231 | A * | 8/1971 | Matson | 198/499 |
| 3,652,074 | A * | 3/1972 | Frederickson et al. | 267/137 |
| 3,698,455 | A * | 10/1972 | Frederickson et al. | 30/381 |
| 4,533,035 | A * | 8/1985 | Reiter | 198/499 |
| 4,535,883 | A * | 8/1985 | Kerr | 198/499 |
| 4,819,742 | A * | 4/1989 | Driggers | 173/162.2 |
| 5,361,500 | A * | 11/1994 | Naslund et al. | 30/381 |
| 5,368,107 | A * | 11/1994 | Taomo | 173/162.2 |
| 5,778,747 | A * | 7/1998 | Chen | 83/471.3 |
| 6,375,171 | B1 * | 4/2002 | Zimmermann et al. | 267/137 |
| 6,446,421 | B1 * | 9/2002 | Kramer et al. | 56/233 |
| 6,643,897 | B2 * | 11/2003 | Chang | 16/248 |
| 6,643,939 | B2 * | 11/2003 | Tajima et al. | 30/381 |
| 2002/0104665 | A1 * | 8/2002 | Wolf et al. | 173/162.2 |
| 2004/0231867 | A1 * | 11/2004 | Becht et al. | 173/162.2 |

* cited by examiner

*Primary Examiner*—Rinaldi I. Rada
*Assistant Examiner*—Lindsay Low
(74) *Attorney, Agent, or Firm*—Walter Ottesen

(57) ABSTRACT

An antivibration unit of a portable handheld work apparatus includes a leg spring (3) having at least one wire turn (5) and at least one first wire leg (6). The wire turn (5) extends about a turn or coil axis (4) and is attached at the first component assembly (1) and the first wire leg (6) extends outwardly and tangentially from the wire turn (5). A wire leg end (7) of the wire leg (6) is attached to the second component assembly (2).

16 Claims, 2 Drawing Sheets

ANTIVIBRATION UNIT OF A PORTABLE HANDHELD WORK APPARATUS

CROSS REFERENCE TO RELATED APPLICATION

This application claims priority of German patent application no. 10 2004 055 758.6, filed Nov. 18, 2004, the entire content of which is incorporated herein by reference.

FIELD OF THE INVENTION

The invention relates to an antivibration unit of a portable handheld work apparatus such as a chain saw, cutoff machine or the like for providing a vibration decoupling connection of two component assemblies of the work apparatus.

BACKGROUND OF THE INVENTION

Portable handheld work apparatus are held and guided by an operator at one or several handles during operation. The drive motor and a tool driven by the drive motor generate vibrations which are transmitted to the handles and from there to the hands of the operator. For precise and non-tiring work, a lowest possible vibration level in the area of the handles is strived for.

A great many antivibration units are known for the vibration decoupling connection of two component assemblies of the work apparatus, such as a motor assembly and a handle assembly. The use of rubber elements as antivibration elements is widespread. These rubber elements are matched to the vibration behavior of the work apparatus with respect to their stiffness and their material damping. The high transverse contraction number of the rubber material leads to a high transverse expansion during an axial loading of the rubber antivibration element for which a corresponding structural space must be made available. The spring/damper characteristic of the rubber material changes with the excitation frequency which operates thereon. An increase of the dynamic stiffness occurs with increasing excitation frequency. A static configuration is to be selected, which is very soft at rest without influence of the dynamic stiffness increase, in order to achieve an adapted, adequately soft matching adapted to the operating frequencies of the work apparatus. The low static stiffness can act disadvantageously on the guiding accuracy of the work apparatus. A compromise between guiding accuracy and vibration decoupling has to be found in the configuration.

Furthermore, antivibration elements in the form of a spiral spring made of steel wire are known. A matching of the vibration system is comparatively simple because of the linear spring characteristic which is essentially independent of frequency. However, the large required axial space needed for the spring is disadvantageous.

SUMMARY OF THE INVENTION

It is an object of the invention to provide an antivibration unit of a portable handheld work apparatus having good vibration decoupling characteristics while at the same time requiring less space for accommodating the same.

The antivibration unit of a portable handheld work apparatus of the invention is for connecting first and second component assemblies of the work apparatus to decouple vibrations between the component assemblies. The antivibration unit includes: a leg spring having at least one wire turn defining a coil axis; the wire turn being attached to the first component assembly; the leg spring further having a first wire leg projecting outwardly from the wire turn; and, the first wire leg having an end portion attached to the second component assembly so as to cause the leg spring to be subjected to load in the manner of a flexural bar during operation of the work apparatus.

An antivibration unit having a leg spring is proposed. The leg spring has at least one wire turn which runs about a turn or coil axis and is attached to a first component assembly. Furthermore, the leg spring is provided with at least one first wire leg projecting outwardly away from the wire turn. The end of this wire leg is attached to a second component assembly. The wire leg preferably projects tangentially from the wire turn. A vibration-caused relative displacement of the two component assemblies is transmitted by means of the wire leg to the wire turns which are loaded in the peripheral direction. The wire turns can be wound tightly one against the other because of the absence of axial load whereby a very small axial structural space is required. The tangential forces are introduced via the wire leg and cause a bending load of the wire material in the wire turns. This bending load manifests itself in a comparatively small oscillating increase or decrease of the turn diameter. Only a small structural space is required also in a radial direction. The wire turns require only one structural space in radial direction. A small radial play releases the oscillating diameter changes. The length of the wire leg, the wire diameter and especially the number of wire turns can be adapted in a small structural space in such a manner to the occurring vibration loads that stiffness and spring displacement are associated with a low material loading of the antivibration unit.

In an advantageous further embodiment of the invention, the at least one wire turn is held on a lug extending along the turn or coil axis and engages around the lug with radial play. With the lug, simple and effective means are formed for guidingly attaching the wire turns in radial direction. The radial play between the wire turns and the lug permits a bending load of the turn packet in the peripheral direction in such a manner that the turn package can freely contract in radial direction. The wire turns are not hindered in their spring behavior.

In a further practical embodiment of the invention, the at least one wire turn is held on the lug in an axial direction form tight between two wall sections. With simple means, an axial securing of the wire turns is formed without affecting its spring action.

At the end of the wire leg, a bearing pin for attaching the wire leg end to the second component assembly is arranged at right angles to the corresponding first wire leg and axially parallel to the turn axis. The bearing pin is provided for the rotatable journalling in the second component assembly, for example, in a handle. The rotatable journalling of the bearing pin permits an unhindered deflection of the wire leg without affecting the spring damping ratio and without mechanical overloading at the attachment point of the second component assembly.

The bearing pin is configured as a snap pin and permits a simple assembly without tools.

In an advantageous embodiment of the invention, at least a partial region of the first wire leg is held in a guide which holds the first wire leg in axial direction and enables it to move in a direction peripheral to the turn or coil axis. The first wire leg is held in the guide only with a base section close to the turns. The guide permits a precise decoupling of the vibration loading tangentially to the turn axis from vibration loads in axial direction. Depending upon the configuration of the guide, the antivibration element can be rigid in axial direction. In a guide, which is limited to the turns-near base section, the unsupported end of the wire leg, which lies outwardly, effects a stiffly designed decoupling as a consequence of its own yielding. The bending deformation of the wire leg is limited to the section between the introduction of force and the guide without being transferred to the wire turns as a consequence of the support action of the guide. An antivibration element is formed, which exhibits different stiffnesses or transmitting characteristics in two different, mutually perpendicular directions which are decoupled from each other. An adapted direction-independent vibration decoupling can be provided in dependence upon operating loads of the work apparatus which are different in size and direction.

A holding section of the spring leg lies opposite to the wire leg end. This holding Section extends axially parallel to the turn axis and is preferably held form tight in the first component assembly. The holding section engages over the wire turns on the outer side extending axially parallel to the turn axis. A simple reliable fixation of the leg spring in the peripheral direction is formed which is in a position to reliably take up the forces in the peripheral direction with these forces being introduced from the first wire leg. The axially parallel course of the holding section effects an additional slight yielding with which bearing tolerances can be compensated during assembly. The course of the holding section leads outside over the wire turns. The packet of wire turns can lie flat and tight directly against that wall on which also the holding section is attached without it being necessary to bend over the holding section at too tight a radius.

Between the wire turns and the above-mentioned wire holding section, a second wire leg is provided which can contribute to accommodating the form changing energy in the spring material. The second wire leg projects outwardly especially tangential to the wire turns.

In an advantageous embodiment, the leg spring is mounted to lie in the direction of the main thrust forces of the work apparatus with the leg spring being in its direction running in the peripheral direction to the turn axis and standing at right angles to the first wire leg. It is practical that the leg spring is mounted in a direction of lower thrust forces of the work apparatus with its axial direction pregiven by the turn axis. The spring action of the wire turns adjusts in the direction of the main thrust forces. There result also lower material tensions at high deflection forces. The spring action of the antivibration unit is limited in the direction of lower thrust forces to the deformation of the first wire leg between its guide and the introduction of force at its wire leg end. The leg spring acts here as a flexural bar wherein the permissible tension level is not exceeded as a consequence of the slight thrust forces. The remaining spatial direction is advantageously a direction without thrust forces. This direction lies approximately coaxially to the first wire leg in which the leg spring has no significant yielding. A residual yielding is present as a consequence of the radial play between the wire turns and the inner-lying lug. To accommodate forces in this direction, springs, which are spatially separated, elastic stops or separate antivibration elements can be mounted.

BRIEF DESCRIPTION OF THE DRAWINGS

The invention will now be described with reference to the drawings wherein:

FIG. 3 is a plan view of the arrangement shown in FIGS. 1 and 2 in the assembled condition of component assemblies showing details of a guided base section of a first wire leg; and.

DESCRIPTION OF THE PREFERRED EMBODIMENT OF THE INVENTION

Figure 1:
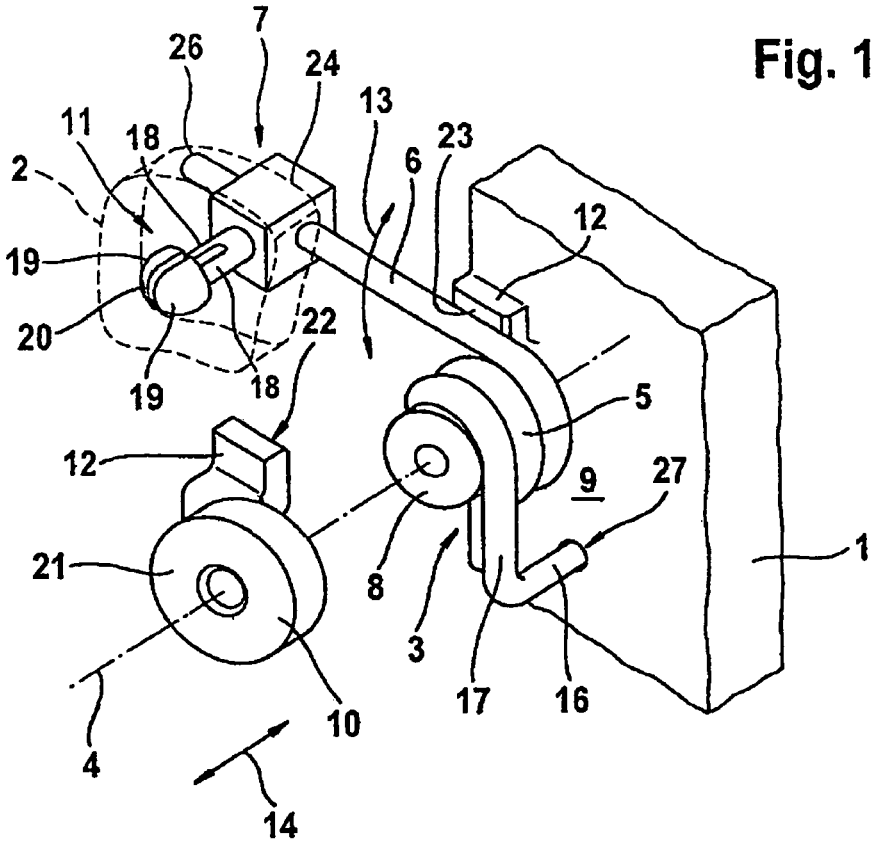
FIG. 1 is a perspective exploded view showing the essential components of the antivibration unit of the work apparatus of the invention.

FIG. 1 shows a perspective exploded view of an antivibration unit for the vibration decoupling connection of two component assemblies (1, 2) of a portable handheld work apparatus. The component assemblies (1, 2) are indicated schematically.

Figure 4:
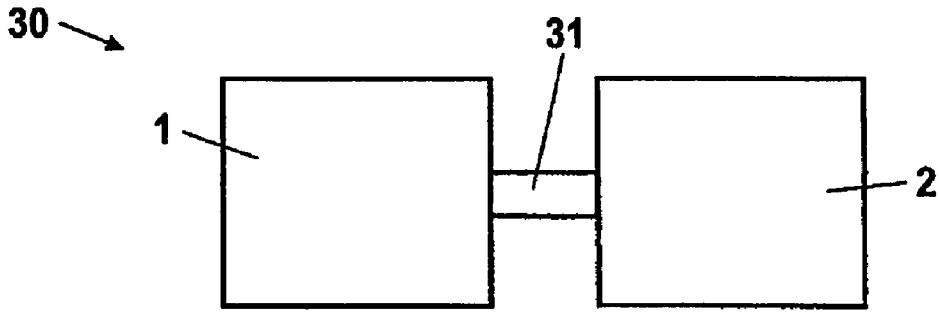
FIG. 4 is a schematic representation of the work apparatus of the invention showing the component assemblies thereof interconnected by the antivibration unit.

The antivibration unit is also shown in FIG. 4 wherein it is identified by reference numeral 31. The work apparatus also comprises the two component assemblies (1, 2) and the work apparatus is identified by reference numeral 30.

The work apparatus is especially driven by an internal combustion engine and can be a motor-driven chain saw, cutoff machine, hedge trimmer, blower/suction apparatus or the like. The first component assembly 1 can, for example, be a motor housing having a drive motor mounted therein. The second component assembly 2 can, for example, be a handle which is vibration decoupled from the motor housing by means of the antivibration unit shown.

The antivibration unit includes a leg spring 3 which is bent from steel wire running between a first end 26 and a second end 27. The leg spring 3 comprises a first wire leg 6, wire turns 5, a second wire leg 17 and a holding section 16. The first wire leg 6 borders on the first end 26 and the wire turns 5 are wound cylindrically about a turn or coil axis 4. The second wire leg 17 lies in the region of the second end 27 and the holding section 16 borders on the second end 27. Along its course from the first end 26 to the second end 27, the spring wire of the leg spring 3 passes from the first wire leg 6 into the turns 5 and from there into the second wire leg 17 and thereafter into the holding section 16.

A cylindrical lug 8 is attached to the first component assembly 1. The wire turns 5 are pushed onto the lug 8 with a slight radial play. In this way, the turn axis 4 of the cylindrical packet of wire turns 5 lies coaxially to the lug 8. The wire turns 5 lie one against the other in the axial direction 14 pregiven by the turn axis 4.

The second leg 17 lies between the wire turns 5 and the holding section 16 and extends linearly starting from the wire turns 5. The second wire leg 17 projects outwardly tangentially to the wire turns 5. The wire leg 17 can also be bent over outwardly with a radial directional component. The transition of the wire turns 5 to the second wire leg 17 as well as the wire leg 17 itself lie, with respect to the axial direction 14, on the side of the packet of wire turns 5 which faces away from the first component assembly 1. An axial spacing is formed from the second wire leg 17 to the first component assembly 1. The second wire leg 17 is bent over at right angles to a holding section 16 in a direction of its free end. The holding section 16 runs axially parallel to the turn axis 4 radially on the outside of the wire turns 5 in the direction of the first component assembly 1. The holding section 16 extends radially on the outside beyond the axial length of the packet of wire turns 5. The holding section 16 is inserted with the second end 27 into a corresponding opening of the first component assembly 1 and is held form tight in the peripheral direction referred to the turn axis 4.

To assemble the leg spring 3, the leg spring can be pushed onto the lug 8 parallel to the turn axis 4. The holding section 16 is introduced at the same time into the corresponding opening of the first component assembly 1. Thereafter, a holding element 21 is attached to the lug 8. Respective wall sections (9, 10) are provided on the first component assembly 1 and at the holding element 21. The packet of wire turns 5 is held form tight in axial direction between the wall sections (9, 10). In total, the leg spring 3 is thereby completely attached to the first component assembly 1 and is fixed in all spatial directions.

An embodiment can be practical wherein the second wire leg 17 is omitted. The holding section 16 can, for example, be bent in the opposite direction and be attached to the holding element 21. Likewise, it can be practical to configure the holding leg 16 bent radially inwardly and held in a radial slot of the lug 8. In lieu of the attachment of the wire turns 5 on the lug 8, also an outside guide of the wire turns 5 can be practical, for example, a sleeve-shaped guide. By way of example, approximately two wire turns are shown. Depending upon the operating loads to be expected and the given geometric boundary conditions, any number of wire turns 5 for adapting the vibration performance of the antivibration unit can be practical.

The first wire leg 6 lies on the axial end face of the wire turns 5 referred to the direction of the turn axis 4 and opposite to the second wire leg 17. The first wire leg 6 extends in tangential direction starting from the wire turns 5 outwardly in a direction of the second component assembly 2. The first wire leg 6 can also be bent over outwardly with a radial component. In the embodiment shown, the wire leg 6 runs approximately at right angles to the second wire leg 17. There can also be a different angle position between the two wire legs (6, 17). A wire leg end 7 of the first wire leg 6 lies in the region of the first wire end 26. A support part 24 is attached to the wire leg end 7 and this support part 24 is provided for attaching the wire leg end 7 to the second component assembly 2. A support pin 11 is formed at the support part 24 with this support pin extending at right angles to the first wire leg 6 and axially parallel to the turn axis 4. The support pin 11 can, for example, be formed by a bent-over end of the first wire leg 6. In the embodiment shown, the support pin 11 is configured as a snap pin for latching attachment to the second component assembly 2. For forming the snap pin, two spring latches 18 are provided with each latch having a formed-on latch nose 19. The spring latches 18 are separated from each other by means of a slit 20. The latch nose 19 can be inserted without tools into a suitable holding opening of the second component assembly 2, for example, a handle. The slit 20 permits an elastic deformation of the spring latches 18 relative to each other whereby the latch noses 19 can be inserted. The elastic configuration of the spring latches 18 thereafter effects a spreading of the latch noses 19 whereby the wire leg end 7 is attached form tight to the second component assembly 2 in axial and radial direction referred to the support pin 11 on the second component assembly 2. The support pin 11 is circular in cross section and permits a rotational movement about its longitudinal axis when mounted. A free deflection of the first wire leg 6 in a peripheral direction to the turn axis 4 is ensured. The peripheral direction is indicated by a double arrow 13.

Guide surfaces (22, 23) are formed on the holding element 21 and the first component assembly 1, respectively. These guide surfaces form a guide 12 for a part region of the first wire leg 6. In the assembled state, the wire leg 6 is so held in the guide 12 or between the guide surfaces (22, 23) that the wire leg 6 is held approximately free of play in the axial direction 14 pregiven by the turn axis 4. The first wire leg 6 is freely moveable in the peripheral direction 13. Additional details as to the operation of the guide 12 are provided in greater detail in connection with FIGS. 2 and 3.

Figure 2:
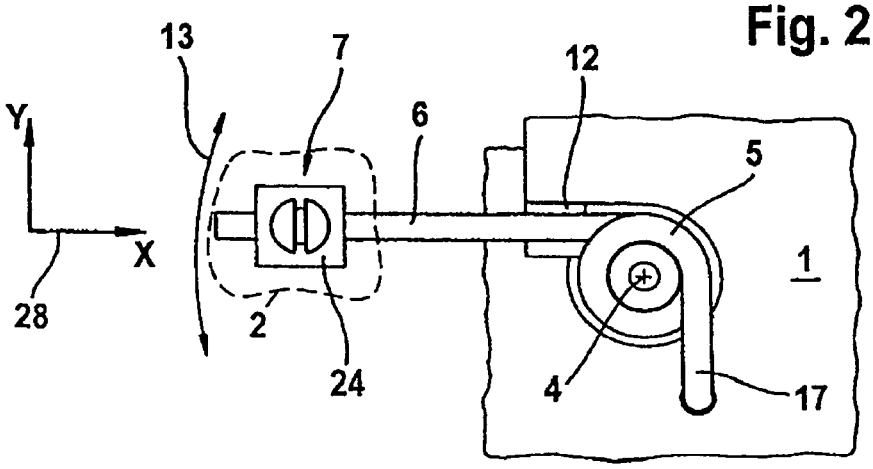
FIG. 2 is a front elevation view of the arrangement of FIG. 1 showing details of wire turns guided on a lug.

FIG. 2 shows the arrangement of FIG. 1 in an end face view in the direction of the turn axis 4. The antivibration unit of the invention is mounted in the work apparatus in such a manner referred to a coordinate system 28 that the first wire leg 6 lies parallel to the X-axis and the turn axis 4 lies parallel to the Z-axis (FIG. 3) of the coordinate system 28. The direction X of the coordinate system 28 is a direction without thrust forces of the work apparatus while the direction Y indicates the direction of the main thrust forces of the work apparatus. In the arrangement of the antivibration element shown relative to the coordinate system 28, the direction Y of the main thrust forces is at right angles to the first wire leg 6 and to the turn axis 4. A mechanical load in the main thrust direction Y effects a relative deflection of the second component assembly 2 relative to the first component assembly 1 in such a manner that the support part 24 moves statically and/or oscillatingly in the peripheral direction to the turn axis 4 with the peripheral direction being indicated by the double arrow 13. The first wire leg 6 experiences bending in the peripheral direction 13. The main part of the bending deformation in the same direction occurs in the wire turns 5 which expand or contract radially referred to the turn axis 4. A further lesser bending component in the same direction arises in the second wire leg 17. The guide 12 lies with its surfaces parallel to the direction of the double arrow 13 whereby the deflection of the wire leg end 7 is made possible in this direction.

Figure 3:
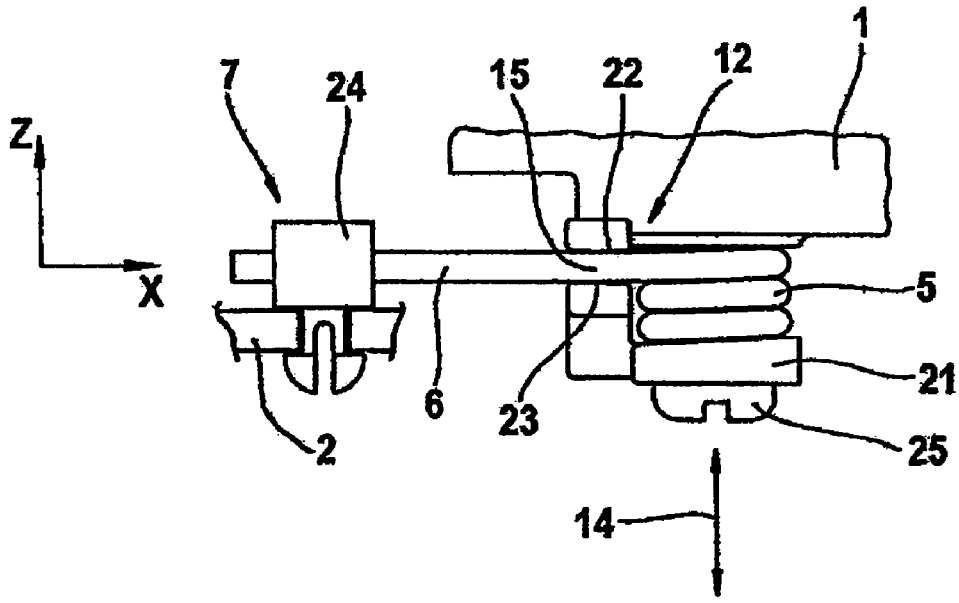

FIG. 3 shows the arrangement of FIGS. 1 and 2 in plan view parallel to the Y direction (FIG. 2). The holding element 21 is threadably fastened to the lug 8 (FIG. 1) by a threaded fastener 25 and is thereby part of the first component assembly 1. The wire turns 5 are held form tight in the axial direction 14 between the first component assembly 1 and the holding element 21. The two guide surfaces (22, 23) lie slidingly at least approximately free of play against a base section 15 of the first wire leg 6. The guide surfaces (22, 23) and the base section 15 extend, referred to the axial direction of the first wire leg 6, over a short region close to the wire turns 5. Accordingly, the first wire leg 6 lies in the guide 12 only with its turns-near base section 15. This permits a yielding of the first wire leg 6 between the guide 12 and the wire leg end 7 in a direction Z of lower thrust forces of the work apparatus.

Smaller relative displacements of the second component assembly 2 with respect to the first component assembly 1 can adjust in the direction Z statically and/or dynamically. The holding of the base section 15 between the guide surfaces (22, 23) effects a support in the axial direction 14 and the forces in the Z direction are held away from the wire turns 5. Loads in the Y direction (FIG. 2) and the Z direction are taken up independently of each other and decoupled from each other. In both directions, a differently stiff designed vibration decoupling of the two component assemblies (1, 2) results. It can be practical to permit the guide 12 to extend over the entire length of the first wire leg 6 whereby the arrangement becomes rigid in the Z direction. A vibration decoupling of the component assemblies (1, 2) is then given only in the Y direction (FIG. 2).

It is understood that the foregoing description is that of the preferred embodiments of the invention and that various changes and modifications may be made thereto without departing from the spirit and scope of the invention as defined in the appended claims.

What is claimed is:

1. A work apparatus comprising:

a first component assembly and a second component assembly; and, an antivibration unit connecting said component assemblies to decouple vibrations between said component assemblies;

said antivibration unit comprising:

a leg spring having at least one wire coil extending about a coil axis;

said wire coil having a peripheral direction lying in a plane perpendicular to said coil axis;

said wire coil being attached to said first component assembly and said wire coil having a plurality of wire turns and extending about said coil axis;

said coil axis defining an axial direction;

said first component assembly and said second component assembly being movable relative to each other in said peripheral direction of said wire coil and in said axial direction;

said leg spring having a tangential direction extending perpendicular to said axial direction in a plane arranged approximately perpendicularly to said coil axis;

said leg spring further having a first wire leg projecting outwardly from said wire coil referred to said coil axis and projecting in said tangential direction and said first wire leg extending in said plane arranged approximately perpendicularly to said coil axis;

said first wire leg having an end portion attached to said second component assembly so as to cause said leg spring to be subjected to a load in the manner of a flexural bar during operation of said work apparatus so as to permit a vibration-caused relative displacement of said first and second component assemblies in said peripheral direction to be transmitted via said first wire leg to said wire turns and thereby load said wire turns in said peripheral direction to said wire coil;

a guide for holding at least a segment of said first wire leg; and, said guide not blocking said first wire leg in said peripheral direction of said wire coil and said guide holding said first wire leg against movement in said axial direction so that vibration loads in said axial direction and in said peripheral direction are absorbed essentially independently of each other with said vibration loads in said axial direction being absorbed essentially by said first wire leg between said guide and the location of the introduction of force and said vibration loads in said peripheral direction being taken up essentially by said wire coil.

2. The work apparatus of claim 1, further comprising:

a lug disposed so as to extend along said coil axis; and, said wire coil being held on said lug.

3. The work apparatus of claim 2, wherein said wire coil engages around said lug with radial play.

4. The work apparatus of claim 2, further comprising first and second wall sections disposed with respect to said wire coil so as to hold said wire coil form tight therebetween on said lug in the direction of said coil axis.

5. The work apparatus of claim 1, further comprising a support pin for attaching said end portion of said first wire leg to said second component assembly; and, said support pin being at right angles to said first wire leg and axially parallel to said coil axis.

6. The work apparatus of claim 5, wherein said support pin is configured as a snap pin.

7. The work apparatus of claim 1, wherein said segment is a base segment of said first wire leg close to said wire turn; and, said guide holds said first wire leg only at said base segment.

8. The work apparatus of claim I, said leg spring further having a holding section lying opposite said end portion and said holding section extending axially parallel to said coil axis.

9. The work apparatus of claim 8, wherein said holding section is held form tight in said first component assembly.

10. The work apparatus of claim 9, wherein said holding section extends outside of and beyond said wire coil.

11. The work apparatus of claim 9, wherein said leg spring includes a second wire leg projecting outwardly from said wire coil; and, said second wire leg is disposed between said wire coil and said holding section.

12. The work apparatus of claim 11, wherein said second wire leg extends tangentially to said wire turn.

13. The work apparatus of claim 1, wherein said leg spring has a direction which is at right angles to said first wire leg and extends in a peripheral direction to said coil axis; and, said leg spring is mounted with said direction thereof in a direction (Y) of the thrust forces of said work apparatus.

14. The work apparatus of claim 1, wherein said leg spring has an axial direction which is pregiven by said coil axis; and, said leg spring is mounted with said direction in a direction (Z) of lower thrust forces of said work apparatus.

15. The work apparatus of claim 1, wherein said work apparatus is a work apparatus such as a chain saw, cutoff machine, brushcutter or a blower/suction apparatus.

16. A work apparatus comprising: a first component assembly and a second component assembly; and, an antivibration unit connecting said component assemblies to decouple vibrations between said component assemblies;

said antivibration unit comprising:

a leg spring having a wire coil defining a coil axis;

said wire coil having a peripheral direction lying in a plane perpendicular to said coil axis;

said first and second component assemblies being moveable relative to each other in said peripheral direction;

said wire coil having a plurality of wire turns and being attached to said first component assembly and extending about said coil axis;

said coil axis defining an axial direction;

said leg spring having a tangential direction extending perpendicular to said axial direction and in a plane arranged approximately perpendicularly to said coil axis;

said leg spring being made of spring wire and further having a first wire leg projecting outwardly as a continuation of one of said turns from said wire coil referred to said coil axis and said first wire leg extending in said tangential direction and in said plane arranged approximately perpendicularly to said coil axis;

said first wire leg having an end portion attached to said second component assembly so as to cause said leg spring to be subjected to load in the manner of a flexural. bar during operation of said work apparatus with said load being applied to said first wire leg in said peripheral direction in said plane as well as in said axial direction; and, all of said wire turns of said wire coil of said leg spring being wound tightly one against the other and wherein all of said wire turns lie directly one against the other in said axial direction of said coil axis so as to cause mutually adjacent ones of said wire turns to touch each other in the unloaded state of said leg spring so as to permit said wire coil to absorb essentially only that portion of said load acting in said peripheral direction in said plane and thereby providing a compact configuration of said wire coil in said axial direction.

* * * * *

UNITED STATES PATENT AND TRADEMARK OFFICE

CERTIFICATE OF CORRECTION

PATENT NO. : 7,571,776 B2
APPLICATION NO. : 11/281413
DATED : August 11, 2009
INVENTOR(S) : Johannes Menzel It is certified that error appears in the above-identified patent and that said Letters Patent is hereby corrected as shown below:

In column 3:
Line 15: delete "Section" and substitute -- section -- therefor.

In column 4:
Line 4: delete "and." and substitute -- and, -- therefor.

In column 8:
Line 66: delete "flexural." and substitute -- flexural -- therefor.

Signed and Sealed this

Third Day of November, 2009

David J. Kappos

David J. Kappos
*Director of the United States Patent and Trademark Office*